US010087789B2

(12) United States Patent
Guillaume et al.

(10) Patent No.: US 10,087,789 B2
(45) Date of Patent: Oct. 2, 2018

(54) CAM FOLLOWER, INJECTION PUMP AND VALVE ACTUATOR COMPRISING SUCH A CAM FOLLOWER, AND MANUFACTURING METHOD

(71) Applicants: Jouanno Guillaume, Plouha (FR); Nicolas Berruet, Artannes sur Indre (FR); François Champalou, Chaumont-sur-Loire (FR); Benoît Hauvespre, Saint Etienne de Chigny (FR); Samuel Viault, Saint-Antoine-du-Rocher (FR)

(72) Inventors: Jouanno Guillaume, Plouha (FR); Nicolas Berruet, Artannes sur Indre (FR); François Champalou, Chaumont-sur-Loire (FR); Benoît Hauvespre, Saint Etienne de Chigny (FR); Samuel Viault, Saint-Antoine-du-Rocher (FR)

(73) Assignee: AKTIEBOLAGET SKF, Gothenburg (SE)

( * ) Notice: Subject to any disclaimer, the term of this patent is extended or adjusted under 35 U.S.C. 154(b) by 246 days.

(21) Appl. No.: 15/098,808

(22) Filed: Apr. 14, 2016

(65) Prior Publication Data

US 2016/0305290 A1 Oct. 20, 2016

(30) Foreign Application Priority Data

Apr. 15, 2015 (EP) ..... 15305567

(51) Int. Cl.
*F01L 1/14* (2006.01)
*F01L 1/16* (2006.01)
(Continued)

(52) U.S. Cl.
CPC ..... *F01L 1/16* (2013.01); *F01L 1/14* (2013.01); *F01L 1/143* (2013.01); *F02M 59/102* (2013.01);
(Continued)

(58) Field of Classification Search
CPC . F01L 1/16; F01L 2013/00; F01L 1/14; F01L 2105/02; F01L 2107/00; F02M 59/102
(Continued)

(56) References Cited

U.S. PATENT DOCUMENTS 6,257,185 B1 7/2001 Groh et al.
7,146,952 B2 * 12/2006 Kreil ..... F01L 1/143 123/90.5
8,104,442 B2 * 1/2012 Dorn ..... F01L 1/143 123/90.48

FOREIGN PATENT DOCUMENTS

DE 102004036108 A1 2/2006
EP 2853696 A1 4/2015
(Continued)

*Primary Examiner* — Ching Chang
(74) *Attorney, Agent, or Firm* — Bryan Peckjian; SKF USA Inc. Patent Dept.

(57) ABSTRACT

The invention concerns a cam follower including a tappet having a cylindrical outer surface centered on a longitudinal axis (Y1) and adapted to slide in a housing surrounding the tappet, a pin extending between two opposite ends along a transverse axis (X1) perpendicular to the longitudinal axis (Y1), a roller element movable in rotation relative to the pin around the transverse axis (X1) and adapted to roll on a cam, and an antirotation member for preventing a rotation of the tappet around the longitudinal axis (Y1) in the housing. According to the invention, the antirotation member is one of overmolded onto the tappet and the tappet is overmolded onto the antirotation member. The invention also concerns
(Continued)

an injection pump for a motor vehicle, each having a cam follower. The invention also concerns a method for manufacturing a cam follower.

15 Claims, 2 Drawing Sheets

(51) Int. Cl.
*F02M 59/10* (2006.01)
*F04B 1/04* (2006.01)

(52) U.S. Cl.
CPC ..... *F04B 1/0426* (2013.01); *F01L 2103/00* (2013.01); *F01L 2105/02* (2013.01); *F01L 2107/00* (2013.01)

(58) Field of Classification Search
USPC ..... 123/90.44, 90.48, 90.5
See application file for complete search history.

(56) References Cited

FOREIGN PATENT DOCUMENTS

| | | | |
|---|---|---|---|
| JP | H06146819 | A | 5/1994 |
| JP | 2001/329809 | A | 11/2001 |

* cited by examiner

CAM FOLLOWER, INJECTION PUMP AND VALVE ACTUATOR COMPRISING SUCH A CAM FOLLOWER, AND MANUFACTURING METHOD

CROSS-REFERENCE TO RELATED APPLICATIONS

This is a Non-Provisional Patent Application, filed under the Paris Convention, claiming the benefit of European Patent Application Number 15305567.8, filed on 15 Apr. 2015, which is incorporated herein by reference in its entirety.

TECHNICAL FIELD OF THE INVENTION

The invention concerns a cam follower. The invention also concerns an injection pump and a valve actuator for a motor vehicle, each comprising such a cam follower. The invention also concerns a method for manufacturing such a cam follower.

BACKGROUND OF THE INVENTION

JP-A-2001/329809 discloses a cam follower, comprising a tappet, a pin and a roller. The tappet extends along a longitudinal axis, while the pin and the roller are centered on a transverse axis. The tappet is movable back and forth along the longitudinal axis in a housing, while the roller is movable in rotation around its central axis on a cam. A projecting portion is formed at the outer surface of the tappet and disposed in a groove formed in the housing. Thus, the tappet is prevented from rotating around its longitudinal axis in the housing. In other words, the projecting portion forms an antirotation member formed integral with the tappet.

SUMMARY OF THE INVENTION

The aim of the invention is to provide an improved cam follower.

To this end, the invention concerns a cam follower, comprising: a tappet having a cylindrical outer surface centered on a longitudinal axis and adapted to slide in a housing surrounding the tappet, a pin extending between two opposite ends along a transverse axis perpendicular to the longitudinal axis, a roller element movable in rotation relative to the pin around the transverse axis and adapted to roll on a cam, and an antirotation member for preventing a rotation of the tappet around the longitudinal axis in the housing. According to the invention, the antirotation member is overmoulded onto the tappet, or the tappet is overmolded onto the antirotation member.

Thanks to the invention, wear of the antirotation member can be reduced and lifetime of the cam follower can be improved. Since the tappet and the antirotation member are two different components, they can each be made of specific materials, chosen for specific conditions of operation. Besides, the mechanical connection obtained by overmolding is tighter than by clipping.

According to further aspects of the invention which are advantageous but not compulsory, such a cam follower may incorporate one or several of the following features:

- The antirotation member is made of a harder material than the tappet.
- The antirotation member is made of metal, for example made of steel.

- The antirotation member has a leg positioned in a hole formed in the tappet and a head protruding from the cylindrical outer surface of the tappet opposite the longitudinal axis.
- The antirotation member has an outer surface with a curved, triangular or rectangular shape in a sectional plane perpendicular to the longitudinal axis.
- Several antirotation members are overmoulded onto the tappet, or the tappet is overmolded onto several antirotation members.
- The antirotation members are regularly distributed around the longitudinal axis.
- The cam follower further provides a support element mounted in the tappet and supporting the pin.
- The support element is fitted in recesses formed in the tappet.
- Each pin end is mounted between a half-cylindrical section formed in the tappet and a half-cylindrical section formed in the support element.
- The support element is a metal insert, for example made of steel.
- The cam follower provides a bearing interposed between the pin and the roller element.
- The tappet is made of synthetic material.

The invention also concerns an injection pump or a valve actuator for a motor vehicle, comprising a cam follower as defined here-above.

The invention also concerns a method for manufacturing a cam follower as described here-above. The method provides a step of overmolding the antirotation member onto the tappet, or the tappet onto the antirotation member.

BRIEF DESCRIPTION OF THE DRAWINGS

The invention will now be explained in correspondence with the annexed figures, and as an illustrative example, without restricting the object of the invention. In the annexed figures.

DETAILED DESCRIPTION OF THE INVENTION

Figure 2:
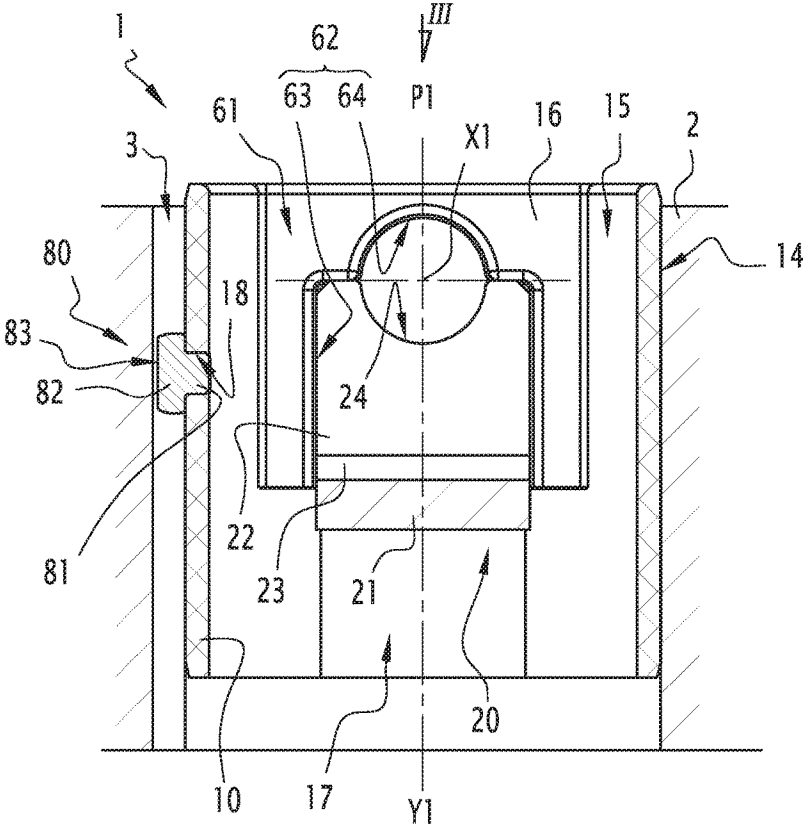
FIG. 2 is a second sectional view of the cam follower, in a second plane perpendicular to the first plane and including the longitudinal axis of the cam follower, showing only the tappet and the insert.
Figure 1:
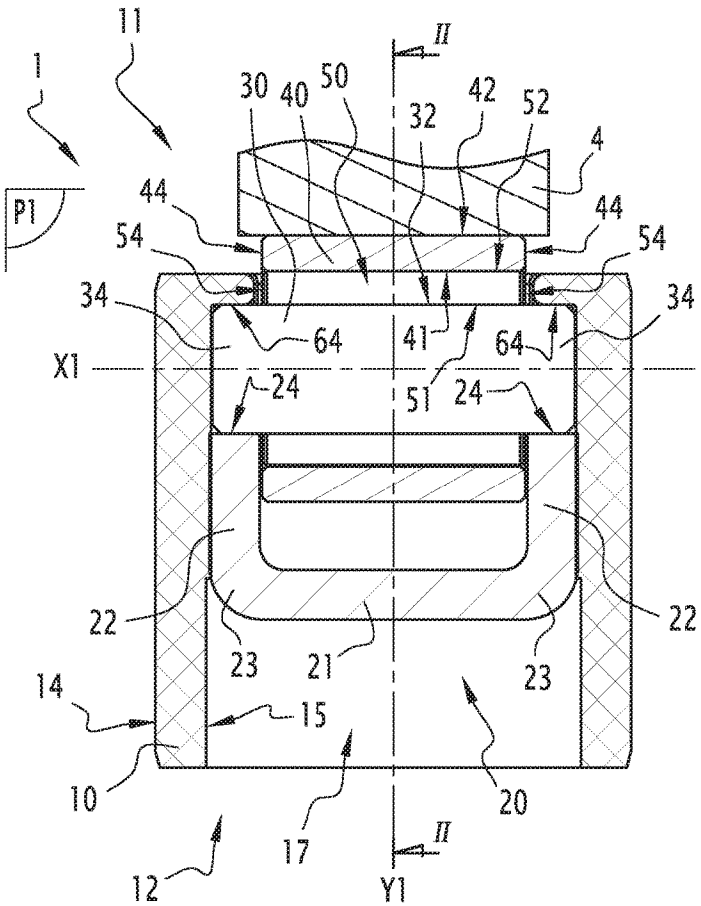
FIG. 1 is a first sectional view of a cam follower according to the invention, in a first plane including the longitudinal axis of the cam follower, showing a tappet, an insert, a pin and a roller forming the cam follower.
Figure 4:
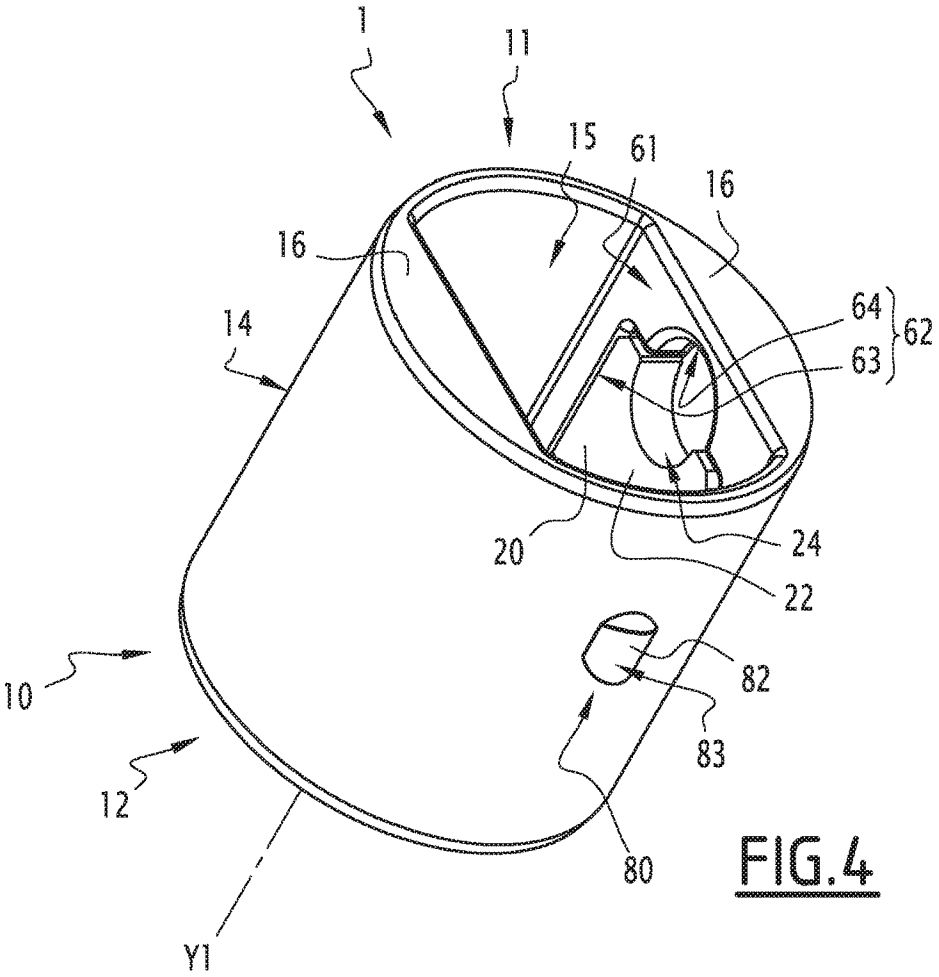
FIG. 4 is a perspective view of the tappet and the insert.
Figure 3:
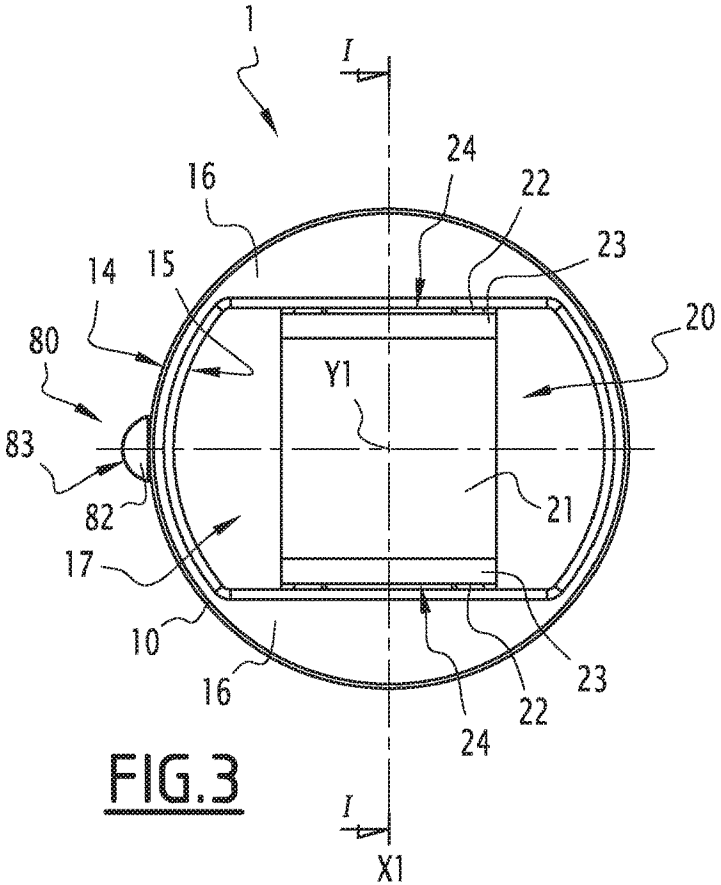
FIG. 3 is an axial view of the cam follower along arrow III of FIG. 2, showing only the tappet and the insert.

The cam follower 1 represented on FIGS. 1 to 4 is adapted to equip a mechanical system, for example an injection pump or a valve actuator for a motor vehicle.

The cam follower 1 provides a tappet 10, an insert 20, a pin 30, a roller 40 and a bush 50, together forming a plain bearing. Pin 30, roller 40 and bush 50 are centered on a transverse axis X1, while tappet 10 is centered on a longitudinal axis Y1. Axes X1 and Y1 are perpendicular. The tappet 10 is mounted in a housing 2, represented only on FIG. 2 for simplification purpose, belonging to the mechanical system. Housing 2 is provided with a groove 3 extending parallel to axis Y1. Housing 2 is preferably made of metal. Tappet 10 is movable back and forth along axis Y1 in housing 2. Roller 40 is adapted to roll on a cam 4, shown only partly on FIG. 1 for simplification purpose.

Tappet 10 has an overall tubular shape centered on axis Y1. Tappet 10 extends along axis Y1 between two ends 11 and 12. Tappet 10 has a cylindrical outer surface 14 and a cylindrical inner bore 15. Tappet 10 also has two inner protruding parts 16, formed on either side of axis X1. Bore 15 and parts 16 delimit a cavity 17 open at both ends 11 and 12. Cavity 17 receives a shaft not shown through end 12, for moving tappet 10 along axis Y1. Surface 14 is adapted to slide in housing 2 surrounding tappet 10. Tappet 10 is preferably made of synthetic material, by example polyamide 6,6 (PA) or polyether-ether-ketone (PEEK). Material of tappet 10 is chosen as a compromise between weight, cost and resistance (to oil flow and temperature variations).

Each inner protruding part 16 has a plane surface 61 extending perpendicular to axis X1. A recess 62 is formed in part 16 and open at surface 61. Recess 62 includes a parallelepiped section 63 and a half-cylindrical section 64 in communication with each other. Sections 63 and 64 are open toward end 12 of tappet 10. Sections 64 are centered on axis X1.

Insert 20 provides a plane central portion 21 and two plane lateral portions 22. Insert 20 provides curved portions 23 connecting portions 21 and 22. Portions 22 form two lateral flanges extending parallel to axis Y1 in a bifurcated manner, from portion 21 toward end 11, on both side of axis Y1. Insert 20 provides a half-cylindrical section 24 formed in each portion 22. Portions 22 are fitted in respective recesses 62, with sections 24 centered on axis X1 and open toward sections 64. Insert 20 is preferably made of stamped metal sheet, for example made of steel. Insert 20 is assembled with tappet 10 by insertion from end 12 and force-fitting in recesses 62

Thanks to insert 20, the shape of tappet 10 can be simplified in comparison with a tappet supporting a pin 30, without support element. Moreover, tappet 10 and insert 20 can each be made of specific materials, chosen for specific conditions of operation. Thus, lifetime of cam follower 1 can be improved.

Pin 30 has a cylindrical outer surface 32 extending between two pin ends 34. Roller 40 has an inner cylindrical bore 41 and an outer cylindrical surface 42 extending between two lateral faces 44. Bush 50 has an inner cylindrical bore 51 and an outer cylindrical surface 52 extending between two lateral faces 54. Surface 32 of pin 30 is adjusted with bore 51 of bush 50, while surface 52 of bush 50 is adjusted with bore 41 of roller 40.

During assembly of cam follower 1, each end 34 of pin 30 is received in a bore centered on axis X1 and formed by sections 24 and 64. Pin, roller and bush axes merge with axis X1. Roller 40 is then adapted to roll on cam 4, more precisely surface 42 can roll on the outer surface of cam 4, while can follower 1 moves back and forth along axis Y1. When roller 40 rolls on cam 4, each section 26 bears a respective end 36 of pin 30, on which roller 40 is mounted. In other words, insert 20 forms a support element for pin 30 and roller 40.

Cam follower 1 is provided with an antirotation member 80 for preventing tappet 10 from rotating in housing 2 around axis Y1. Member 80 has a leg 81 and a head 82 formed integral with each other. Leg 81 is positioned in a hole 18 formed in tappet 10. Hole 18 is open at both surface 14 and bore 15. Head 82 protrudes from leg 81 and surface 14 opposite axis Y1. Head 82 has an outer surface 83 with a curved shape in a sectional plane perpendicular to axis Y1. Head 82 is positioned in groove 3 of housing 2, thus preventing rotation of tappet 10 around axis Y1. Tappet 10 is maintained in the right angular position around axis Y1 inside housing 2.

According to the invention, tappet 10 is overmolded onto the antirotation member 80, or the antirotation member 80 is overmoulded onto tappet 10. Tappet 10 and member 80 are two different components forming cam follower 1. Thus, tappet 10 and member 80 can each be made of specific materials, chosen for specific conditions of operation. Member 80 is preferably made of a harder material than tappet 10. Member 80 is still preferably made of metal, for example steel. Alternately, member 80 can be made of iron, bronze alloy, glass, wood or synthetic material harder than tappet 10. Tappet 10 is preferably made of synthetic material. Weight and cost of cam follower 1 are reduced in comparison with a tappet 10 made of metal. Besides, wear of member 80 is reduced and lifetime of cam follower 1 is improved in comparison with an antirotation member made of synthetic material.

Other non-shown embodiments can be implemented without leaving the scope of the invention.

According to a non-show embodiment, the antirotation member 80 may have a different shape and/or position. For example, its outer surface 83 may have a triangular or rectangular shape in a sectional plane perpendicular to axis Y1.

According to another non-show embodiment, tappet 10 may be overmolded onto several antirotation members 80. Preferably, the antirotation members 80 are regularly distributed around axis Y1.

According to another non-show embodiment, bush 50 may be replaced by a rolling bearing including a series of needles or rollers distributed around axis X1 between pin 30 and roller 40. According to another non-shown embodiment, cam follower 1 may be devoid of bearing or bush 50, so that pin 30 and roller 40 form together a plain bearing. In this case, surface 32 of pin 30 is adjusted with bore 41 of roller 40.

Whatever the embodiment, at least on antirotation member 80 is overmoulded onto tappet 10, or tappet 10 is overmolded onto at least one antirotation member 80. In addition, technical features of the different embodiments can be, in whole or part, combined with each other. Thus, the cam follower 1 and its manufacturing method can be adapted to the specific requirements of the application.

The invention claimed is:

1. A cam follower comprising:

a tappet having a cylindrical outer surface centered on a longitudinal axis and adapted to slide in a housing surrounding the tappet, the tappet having first and second planar partitions disposed therein, the first and second planar partitions are connected to a longitudinal end of the tappet by first and second parts, the first and second parts are each planar perpendicular to the longitudinal axis, the first and second planar partitions defining first and second tappet recesses therein;

a pin extending between two opposite ends along a transverse axis (X1) perpendicular to the longitudinal axis (Y1);

a support element mounted in the tappet and supporting the pin, the support element comprising a base central portion located on a side of the pin opposite to the longitudinal end of the tappet, the support element having first and second planar lateral portions that support the two opposite ends of the pin, the first and second tappet recesses being configured to slidingly engage the first and second planar lateral portions of the support element;

a roller element movable in rotation relative to the pin around the transverse axis (X1) and adapted to roll on a cam; and an antirotation member for preventing a rotation of the tappet around the longitudinal axis (Y1) in the housing, wherein the antirotation member is one of overmoulded onto the tappet and the tappet is overmolded onto the antirotation member.

2. The cam follower according to claim 1, wherein the antirotation member is made of a harder material than the tappet.

3. The cam follower according to claim 1, wherein the antirotation member is metal and made of steel.

4. The cam follower according to claim 1, wherein the antirotation member includes a leg positioned in a hole formed in the tappet and a head protruding from the cylindrical outer surface of the tappet opposite the longitudinal axis (Y1).

5. The cam follower according to claim 1, wherein the antirotation member includes an outer surface having at least one of a curved, triangular and rectangular shape in a sectional plane perpendicular to the longitudinal axis (Y1).

6. The cam follower according to claim 1, wherein a plurality of antirotation members are one of overmoulded onto the tappet and the tappet is overmolded onto a plurality of antirotation members.

7. The cam follower according to claim 6, wherein the antirotation members are equally distributed around the longitudinal axis (Y1).

8. The cam follower according to claim 1, wherein the first and second planar lateral portions of the support element are planar parallel to the longitudinal axis.

9. The cam follower according to claim 8, wherein each of the first and second planar partitions are perpendicular to the first and second parts of the tappet.

10. The cam follower according to claim 8, wherein each of the two opposite ends of the pin is mounted between a half-cylindrical section formed in each of the first and second planar partitions of the tappet and a half-cylindrical section formed in each of the first and second planar lateral portions of the support element.

11. The cam follower according to claim 8, wherein the support element is a metal insert, made of steel.

12. The cam follower according to claim 1, further comprising a bearing disposed between the pin and the roller element.

13. The cam follower according to claim 1, wherein the tappet is made of synthetic material.

14. A valve actuator for a motor vehicle, the valve actuator comprising: a cam follower having the tappet of claim 1.

15. A method for manufacturing a cam follower, the method comprising the steps of:

providing the tappet of claim 1; and overmoulding one of the antirotation member onto the tappet and the tappet onto the antirotation member.

* * * * *